US011005209B2

(12) United States Patent
Chen

(10) Patent No.: US 11,005,209 B2
(45) Date of Patent: May 11, 2021

(54) RECEPTACLE CONNECTOR

(71) Applicant: SPEED TECH CORP., Taoyuan (TW)

(72) Inventor: Chih-Cheng Chen, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 16/720,545

(22) Filed: Dec. 19, 2019

(65) Prior Publication Data

US 2020/0203874 A1 Jun. 25, 2020

(30) Foreign Application Priority Data

Dec. 20, 2018 (TW) ..... 107146243

(51) Int. Cl.

| | |
|---|---|
| ***H01R 13/42*** | (2006.01) |
| ***H01R 13/424*** | (2006.01) |
| ***H01R 13/02*** | (2006.01) |
| ***H01R 24/60*** | (2011.01) |
| ***H01R 12/55*** | (2011.01) |
| ***H01R 13/516*** | (2006.01) |

(52) U.S. Cl.

CPC ..... *H01R 13/424* (2013.01); *H01R 12/55* (2013.01); *H01R 13/02* (2013.01); *H01R 13/516* (2013.01); *H01R 24/60* (2013.01)

(58) Field of Classification Search

CPC ..... H01R 13/424; H01R 12/55; H01R 13/02; H01R 13/516; H01R 24/60

USPC ..... 439/268

See application file for complete search history.

(56) References Cited

U.S. PATENT DOCUMENTS

| | | | | |
|---|---|---|---|---|
| 8,771,018 | B2 * | 7/2014 | McGrath | H01R 13/6471 439/630 |
| 9,373,920 | B2 * | 6/2016 | Miki | H01R 12/00 |
| 9,935,385 | B2 * | 4/2018 | Phillips | H01R 13/516 |
| 10,468,797 | B2 * | 11/2019 | Yin | B29C 45/0025 |
| 10,651,597 | B2 * | 5/2020 | Xie | H01R 13/62983 |
| 2006/0166560 | A1 * | 7/2006 | Shuey | H01R 13/6595 439/637 |

(Continued)

FOREIGN PATENT DOCUMENTS

| | | |
|---|---|---|
| TW | 296127 U | 1/1997 |
| TW | M451680 U1 | 4/2013 |

(Continued)

*Primary Examiner* — Alexander Gilman

(74) *Attorney, Agent, or Firm* — Birch, Stewart, Kolasch & Birch LLP

(57) ABSTRACT

A receptacle connector includes a contact assembly and a housing. The contact assembly includes first contacts and second contacts extending along a first direction. A first insulative carrier and a second insulative carrier respectively wraps the wrapping regions of the first contacts and the second contacts. The housing includes a receiving space for connecting with the plug connector. The housing includes a first sidewall, a second sidewall, a first end wall, a second end wall, a supporting strip and dividing plates which defined the receiving space. The supporting strip extends along the first direction, and two ends of the supporting strip are respectively connected with the first end wall and the second end wall. The first dividing plate and the second dividing plate respectively extend from the first side wall and the second side wall toward the receiving space and are connected with the supporting strip.

18 Claims, 11 Drawing Sheets

(56) References Cited

U.S. PATENT DOCUMENTS

| | | | | |
|---|---|---|---|---|
| 2007/0123109 | A1* | 5/2007 | Gillespie | H01R 13/26 439/634 |
| 2012/0202363 | A1* | 8/2012 | McNamara | H01R 13/516 439/74 |
| 2014/0302720 | A1* | 10/2014 | Jiang | H01R 13/506 439/630 |
| 2015/0236437 | A1* | 8/2015 | Briant | H01R 12/737 439/636 |

FOREIGN PATENT DOCUMENTS

| | | | |
|---|---|---|---|
| TW | M533339 | U | 12/2016 |
| TW | 201806258 | A | 2/2018 |

* cited by examiner

RECEPTACLE CONNECTOR

CROSS-REFERENCE TO RELATED APPLICATION

This application claims priority to Taiwan Application Serial Number 107146243, filed Dec. 20, 2018, which is herein incorporated by reference in its entirety.

BACKGROUND

Field of Invention

The present invention relates to a receptacle connector. More particularly, the present invention relates to a receptacle connector having a housing.

Description of Related Art

A housing in a typical receptacle connector is used to constrain the assembled base, grounding plate, and two contact insulative carriers. In general, the housing surrounds the insulative carrier and the base collectively, and left the space for contacts and a receiving space for connecting with the plug connector.

However, when the receptacle connector is heated during the wielding process, and the grounding plate and the contacts are stressed, the housing may be deformed or even broken such that the grounding plate and the grounding contacts may form the open circuit. Accordingly, the typical housing cannot provide enough structure strength. Therefore, it is critical to provide a housing with provide enough supporting strength and can withstand deformation.

SUMMARY

The invention provides a receptacle connector applied for connecting with a plug connector.

It is to be understood that both the foregoing general description and the following detailed description are by examples, and are intended to provide further explanation of the invention as claimed.

In some embodiments, the receptacle connector includes a contact assembly and a housing. The contact assembly includes a plurality of first contacts and a plurality of second contacts arranged along a first direction, a first insulative carrier, and a second insulative carrier. Each of the first contacts and the second contacts has a wrapping section, and the first contacts are reversely arranged side by side with the first contacts along a second direction perpendicular to the first direction. The first insulative carrier and the second insulative carrier respectively wraps the wrapping sections of the first contacts and the second contacts. The housing including a receiving space configured to receive the plug connector, and the housing wraps a part of the contact assembly. The housing includes a first side wall and a second side wall extending along the first direction, a first end wall and a second end wall extending along the second direction, a supporting strip extending along the first direction, and a plurality of first dividing plates and a plurality of second dividing plates. The first side wall and the second side wall are respectively connected with the first end wall and the second end wall and form the receiving space. Two ends of the supporting strip are respectively connected with the first end wall and the second end wall. The first dividing plates extend from the first side wall toward the receiving space and are connected with the supporting strip, and the second dividing plates extend from the second side wall toward the receiving space and are connected with the supporting strip.

In some embodiments, the receptacle connector further includes a base, the first insulative carrier has a first hook, the second insulative carrier has a second hook opposite to the first hook, and the first hook and the second hook are configured to be engaged with the base.

In some embodiments, each of the first dividing plates has a first protruding portion wrapped by the first side wall, and each of the second dividing plates has a second protruding portion wrapped by the second side wall.

In some embodiments, a width of a bottom of each of the first dividing plates along the second direction is greater than a width of a top of each of the first dividing plates along the second direction.

In some embodiments, adjacent two of the first dividing plates form a first contact channel, and adjacent two of the second dividing plates form a second contact channel.

In some embodiments, a side of the first contact channel away from the receiving space is closed by the first side wall, and a side of the second contact channel away from the receiving space is closed by the second side wall.

In some embodiments, the first contact channel and the second contact channel communicate with the receiving space.

In some embodiments, each of the first contacts and each of the second contacts has a connecting section, a contacting section and a contacting end connected sequentially, and the connecting section is connected with the wrapping section. The connecting sections and the contacting ends of the first contacts are alternately ordered with the first dividing plates along the first direction, and the connecting sections and the contacting ends of the second contacts are alternately ordered with the second dividing plates along the first direction.

In some embodiments, the contacting sections of the first contacts and the second contacts are located in the receiving space.

In some embodiments, vertical projections of the contacting sections of the first contacts and the second contacts are free from overlapping with a vertical projection of the supporting strip.

In the aforementioned embodiments, since the first dividing plates and the second dividing plates respectively extending from the first side wall and the second side wall are configured to be alternately ordered with the first contacts and the second contacts. And the first dividing plates and the second dividing plates are fixed to the first end wall and the second end wall through the supporting strip. As a result, the housing may include a cross-shaped supporting structure so as to uniformly against the outward force and maintain the electrical connection between the first contacts, the second contacts, and the grounding contacts. Furthermore, design of the supporting strips makes the bonding between the first dividing plates and the second dividing plates be more uniform and stable during the injection process and filing process, thereby increasing the yield rate.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
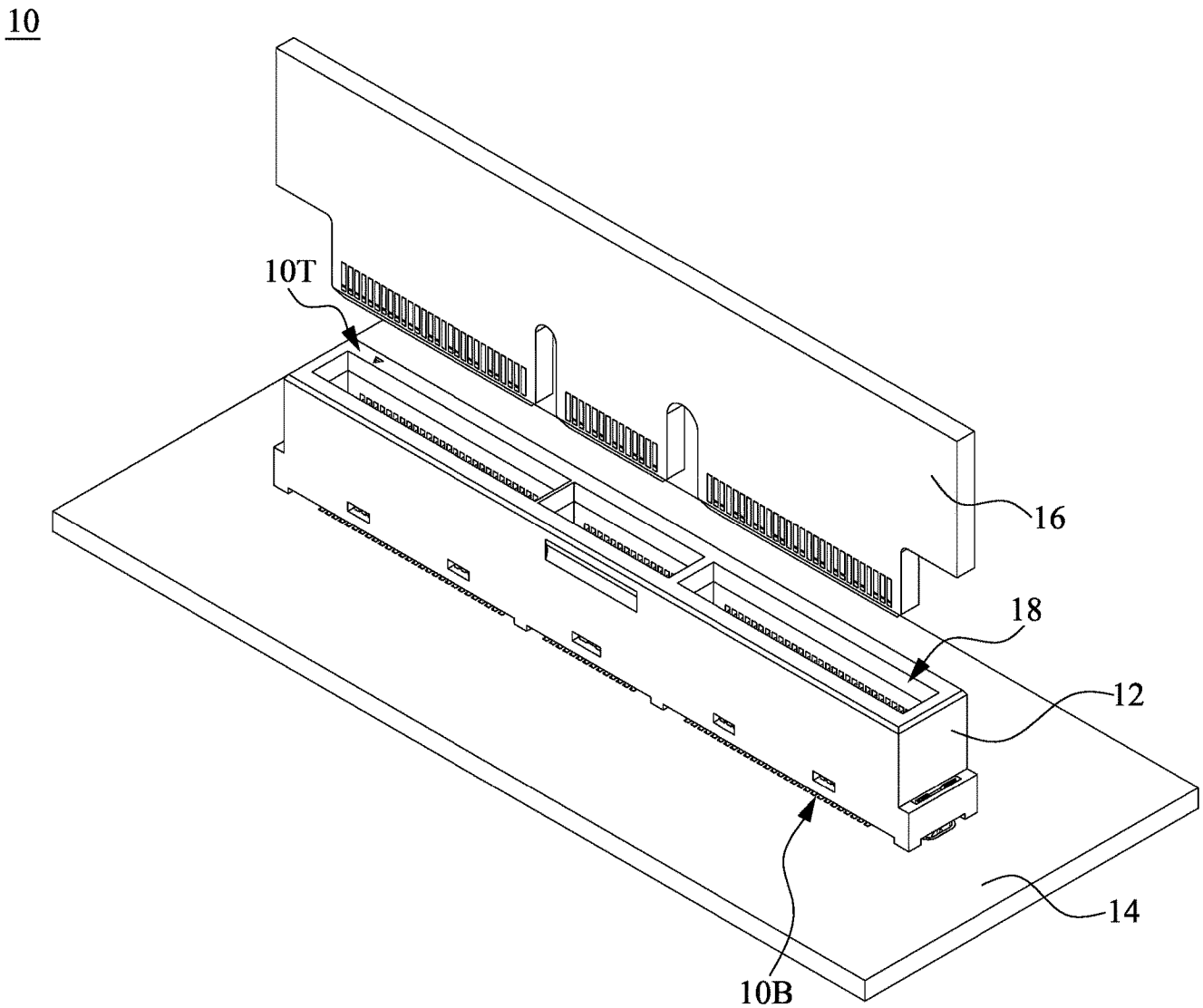
FIG. 1 is a perspective view of a connector according to an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

FIG. 1 is a perspective view of a connector 10 according to an embodiment of the present disclosure. The connector 10 includes a receptacle connector 12, a circuit board 14, and a plug connector 16. A bottom 10B of the receptacle connector 12 is electrically connected with the circuit board 14. A top 10T of the receptacle connector 12 has a receiving space 18 configured to receive the plug connector 16 to be electrically connected with the circuit board 14 and the plug connector 16.

Figure 2:
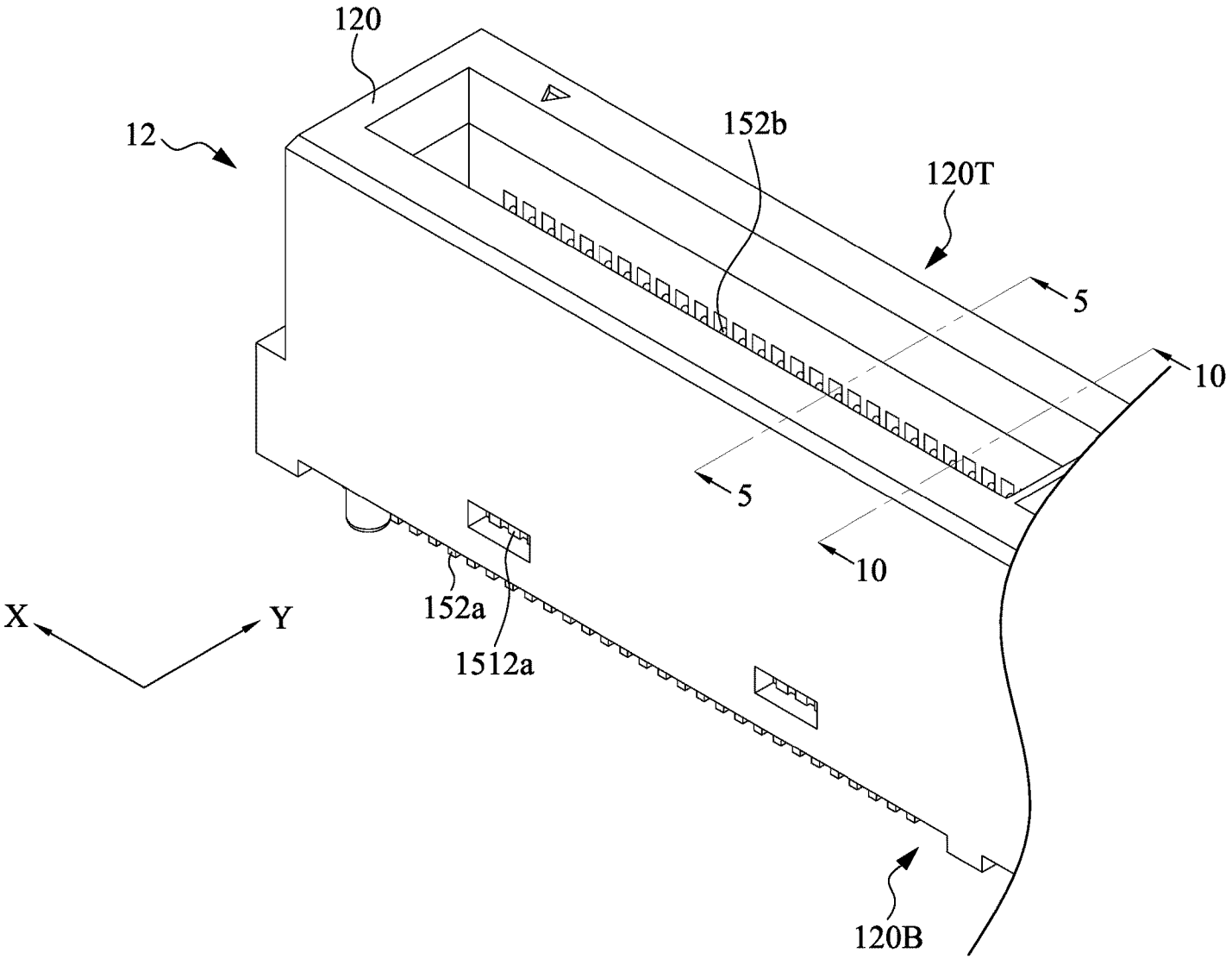
FIG. 2 is a perspective view of a receptacle connector according to an embodiment of the present disclosure.
Figure 3:
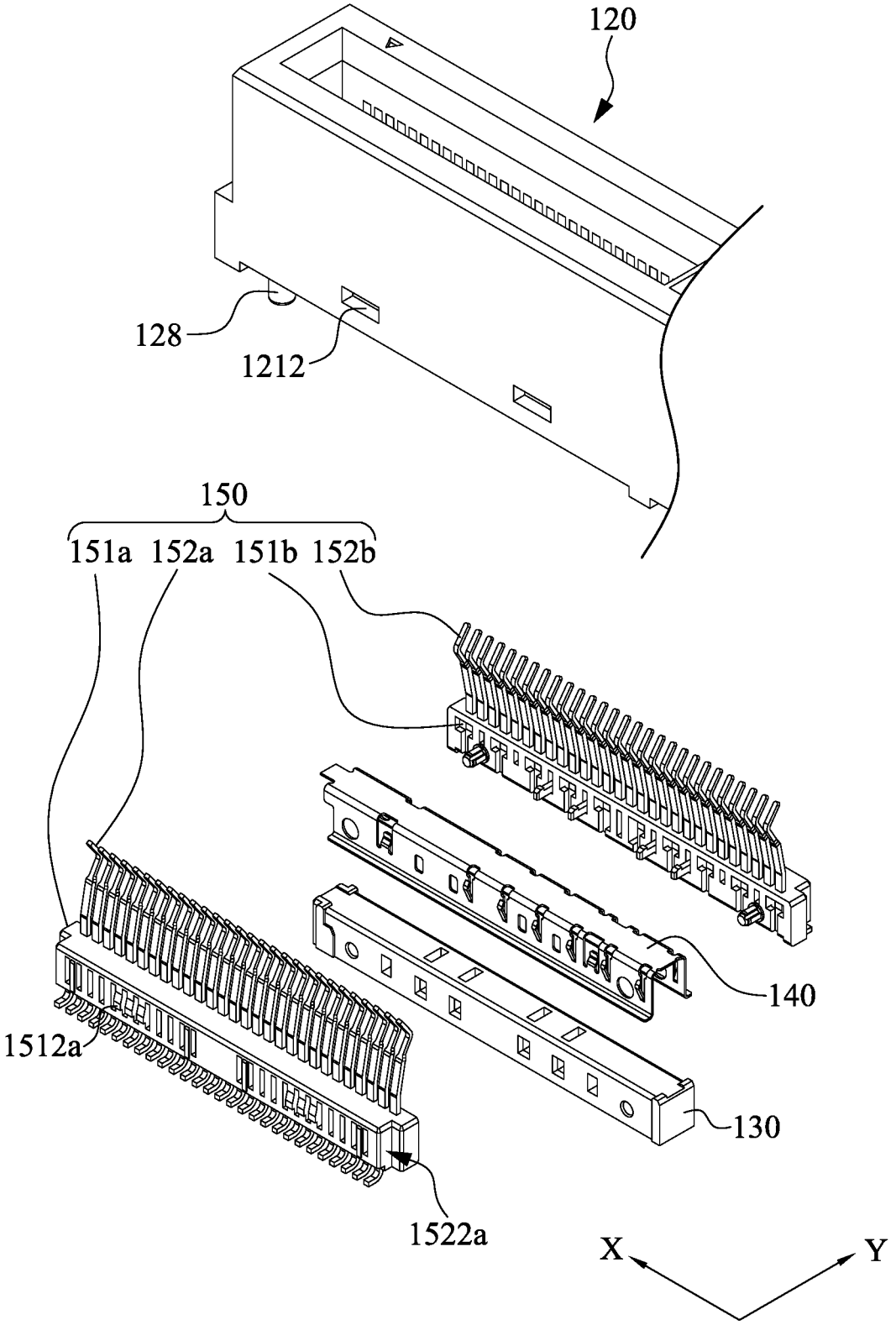
FIG. 3 is an explosive view of the receptacle connector in FIG. 2.

FIG. 2 is a perspective view of a receptacle connector 12 according to an embodiment of the present disclosure. FIG. 3 is an explosive view of the receptacle connector in FIG. 2. The receptacle connector 12 includes a housing 120, a base 130, a grounding plate 140, and a contact assembly 150. The contact assembly 150 has a first insulative carrier 151*a*, a second insulative carrier 151*b*, first contacts 152*a*, and second contacts 152*b*. The grounding plate 140 is mounted and fixed on the base 130. The first insulative carrier 151*a* and the second insulative carrier 151*b* are engaged with two opposite sides of the grounding plate 140. The first contacts 152*a* and the second contacts 152*b* are reversely arranged side by side along a second direction Y. The first contacts 152*a* have wrapping sections 1522*a* which are wrapped in the first insulative carrier 151*a*. Similarly, the second contacts 152*b* have wrapping sections 1522*b* which are wrapped in the second insulative carrier 151*b*. Therefore, the first contacts 152*a* can be fixed and arranged along a first direction X by the first insulative carrier 151*a*, and the second contacts 152*b* can be fixed and arranged along the first direction X by the second insulative carrier 151*b*.

The base 130, the grounding plate 140, and the contact assembly 150 that are assembled can be inserted from the bottom 120B of the housing 120 toward the top 120T to be fixed with the housing 120. The first insulative carrier 151*a* has a spring leaf 1512*a*. Similarly, the second insulative carrier 151*b* has a spring leaf 1512*b*. The housing 120 has a through hole 1212 (through hole on one of the side walls of the housing is shown herein). The spring leaf 1512*a* is engaged with the through hole 1212 by the first insulative carrier 151*a*. As a result, the base 130, the grounding plate 140, and the contact assembly 150 that are assembled can be fixed to the housing 120.

Figure 4:
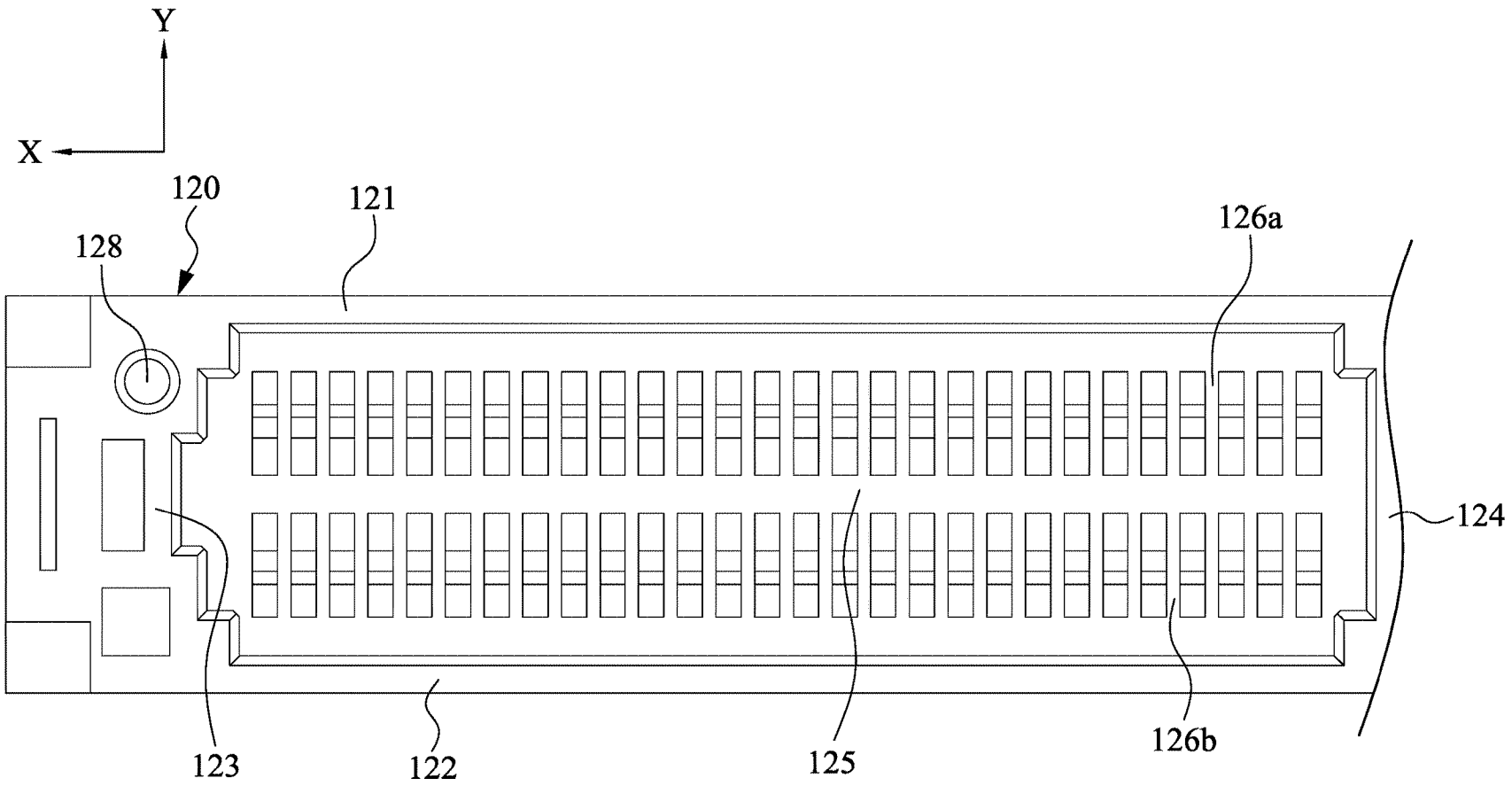
FIG. 4 is a bottom view of the housing in FIG. 2.

FIG. 4 is a bottom view of the housing 120 in FIG. 2. The housing 120 has a first side wall 121, a second side wall 122, a first end wall 123, a second end wall 124, a supporting strip 125, a first dividing plate 126*a*, and a second dividing plate 126*b*. The first side wall 121 and the second side wall 122 extend along the first direction X, the first end wall 123 and the second end wall 124 extend along the second direction Y, and the first direction X is perpendicular to the second direction Y. The supporting strip extends along the first direction X, and two ends of the supporting strip 125 are respectively connected with the first end wall 123 and the second end wall 124.

Figure 5:
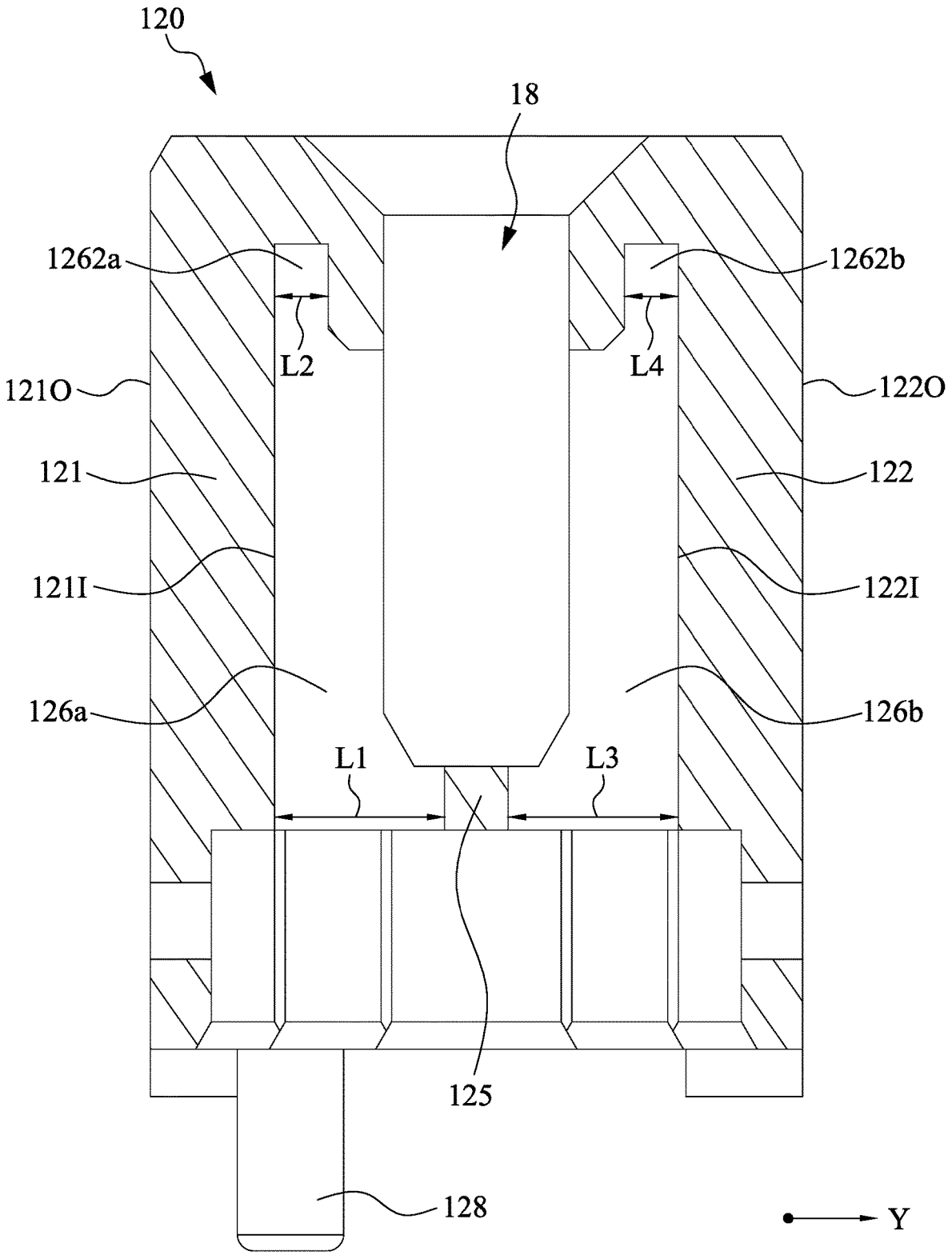
FIG. 5 is a cross-sectional view taken along the line 5-5 in FIG. 2.

FIG. 5 is a cross-sectional view taken along the line 5-5 in FIG. 2. The first end wall 123 and the second end wall 124 are respectively connected with the first side wall 121 and the second side wall 122 and form the receiving space 18. The first dividing plates 126*a* extend from an inner surface 121I of the first side wall 121 toward the receiving space 18 and are connected with the supporting strip 125, and the second dividing plates 126*b* extend from an inner surface 122I of the second side wall 122 toward the receiving space 18 and are connected with the supporting strip 125. Furthermore, the first dividing plates 126*a* and second dividing plates 126*b* are one by one arranged along the second direction Y.

Figure 6:
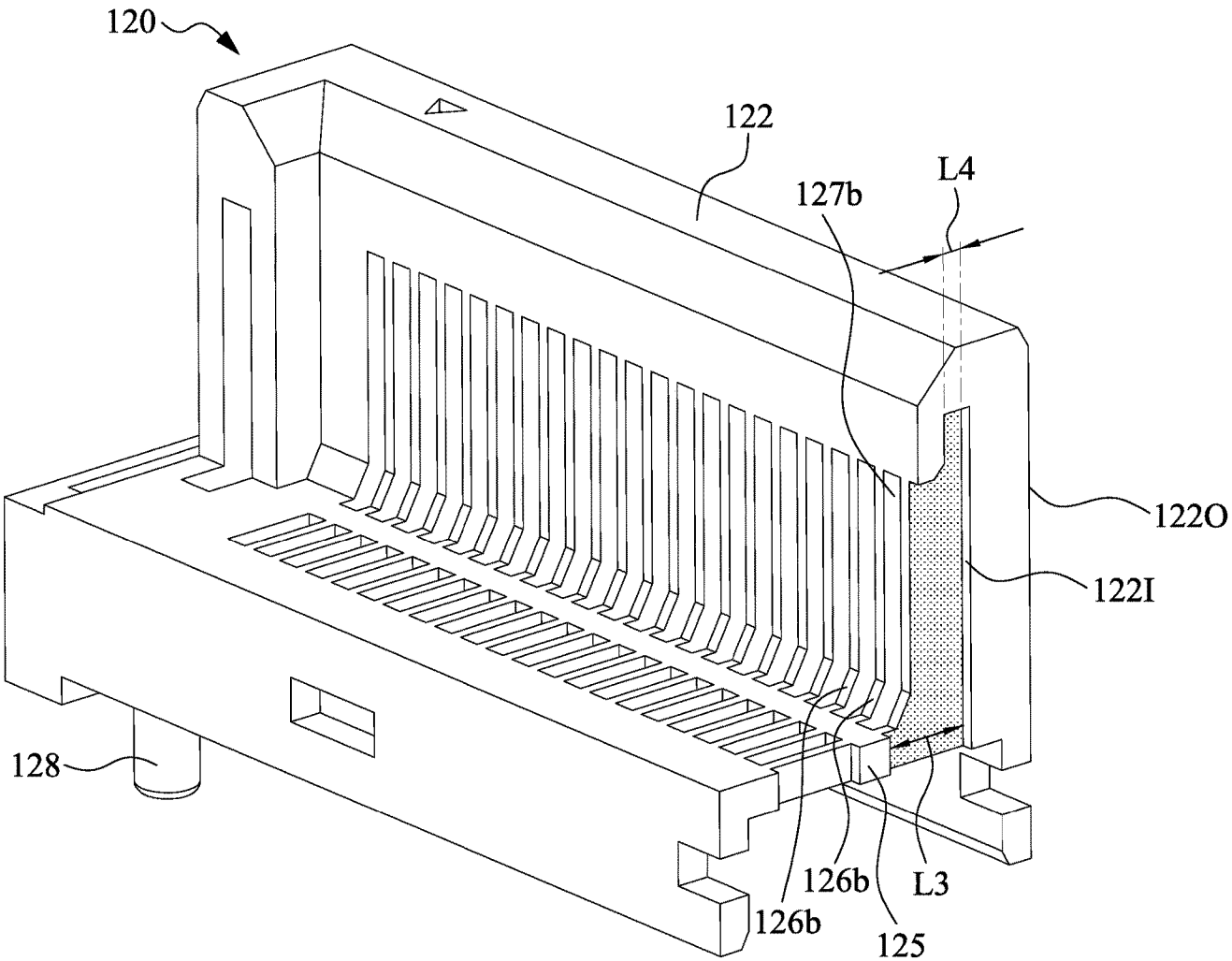
FIG. 6 is a partial cross-sectional perspective view of the receptacle connector in FIG. 2.

FIG. 6 is a partial cross-sectional perspective view of the receptacle connector 12 in FIG. 2. Reference is made to FIG. 5 and FIG. 6. The first dividing plate 126*a* of the housing 120 has a first protruding portion 1262*a*, and the first side wall 121 wraps the first protruding portion 1262*a*. The second dividing plate 126*b* of the housing 120 has a second protruding portion 1262*b*, and the second side wall 122 wraps the second protruding portion 1262*b*. In other words, tops of the two first dividing plates 126*a* are connected together through the first side wall 121, and tops of the two second dividing plate 126*b* are connected together through the second side wall 122.

Furthermore, a width L1 of a bottom of each of the first dividing plates 126*a* along the second direction Y is greater than a width L2 of a top of each of the first dividing plates 126*a* along the second direction Y. A width L3 of a bottom of each of the second dividing plates 126*b* along the second direction Y is greater than a width L4 of a top of each of the second dividing plates 126*b* along the second direction Y.

Adjacent two of the second dividing plates 126*b* form a second contact channel 127*b*. Similarly, adjacent two of the first dividing plates 126*a* form a first contact channel 127*a*. The first contact channel 127*a* and the second contact channel 127*b* communicate with the receiving space 18. Furthermore, a side of the first contact channel 127*a* away from the receiving space 18 is closed by the first side wall 121, and a side of the second contact channel 127*b* away from the receiving space 18 is closed by the second side wall 122. In other words, the first contact channel 127*a* is a ring-shaped contact channel and no extends to an outer surface 121O of the first side wall 121, and the second contact channel 127*b* is a ring-shaped contact channel and no extends to an outer surface 122O of the second side wall 122.

Reference is made to FIG. 5. In the present embodiment, the supporting strip 125 is located at a center of the first side wall 121 and a second side wall 122. In other words, the length of the first dividing plate 126*a* extending from the inner surface 121I of the first side wall 121 is the same as the length of the second dividing plate 126*b* extending from the inner surface 122I of the second side wall 122. In other words, in the present embodiment, the width L1 of the bottom of the first dividing plate 126*a* is equal to the width L3 of the bottom of the second dividing plate 126*b* along the second direction Y. In some other embodiment, the width L1 of the bottom of the first dividing plate 126*a* may not be equal to the width L3 of the bottom of the second dividing plate 126*b* along the second direction Y.

In the present embodiment, the housing 120 further includes a restrain post 128 extending from the bottoms of the first end wall 123 and the second end wall 124. The restrain post 128 is configured to be fixed with the circuit board 14 that is connected with the plug connector 12.

Figure 7:
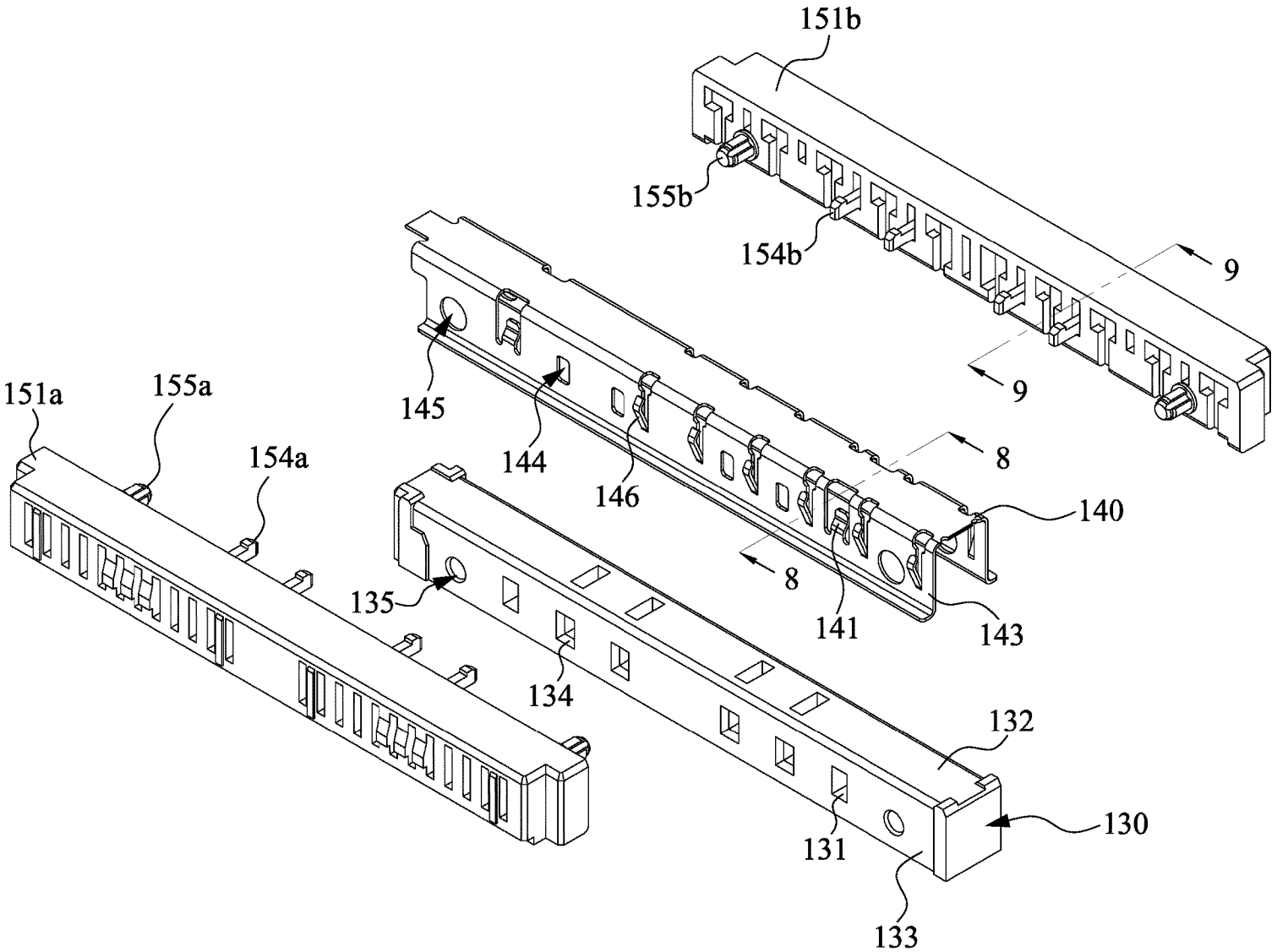
FIG. 7 is a perspective view of when the base, the grounding plate, the first insulative carrier and the second insulative carrier in FIG. 3 are separated.
Figure 8:
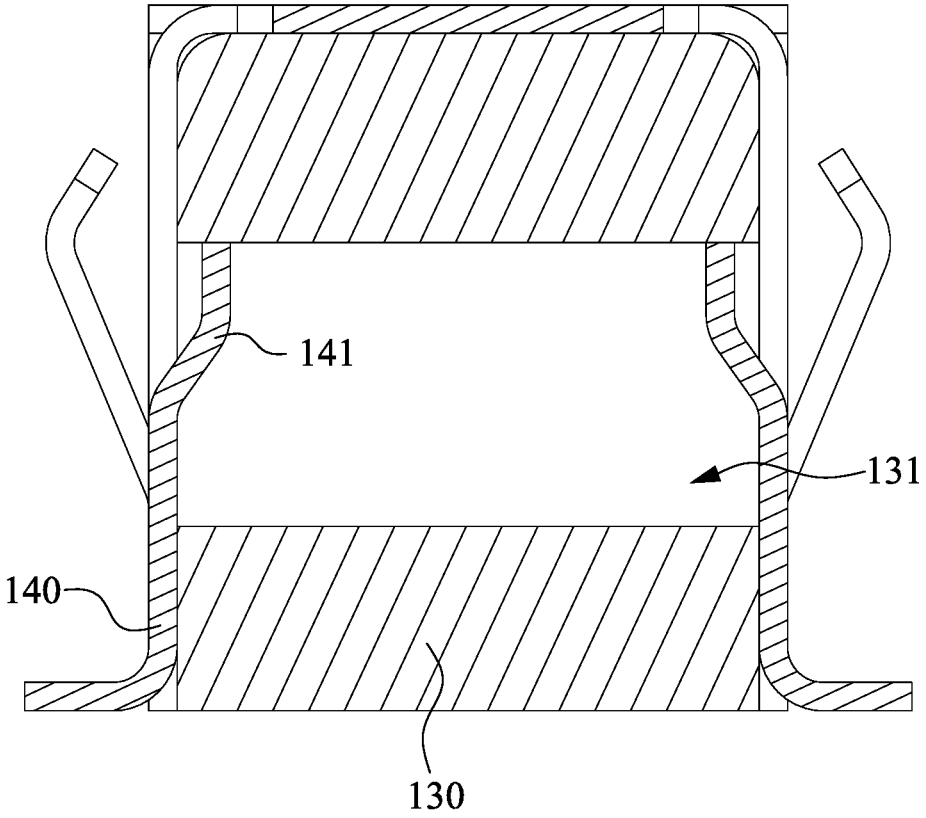
FIG. 8 is a cross-sectional view taken along line 8-8 when the base and the grounding plate in FIG. 7 are assembled.

FIG. 7 is a perspective view when the base 130, the grounding plate 140, the first insulative carrier 151*a* and the second insulative carrier 151*b* in FIG. 3 are separated. FIG. 8 is a cross-sectional view taken along line 8-8 when the base 130 and the grounding plate 140 in FIG. 7 are assembled. Reference is made to FIG. 7 and FIG. 8. In the present embodiment, the base 130 has two through holes 131 located at two opposite sides of the base 130 along the first direction X and communicating with two side surfaces 133 of the base 130. The grounding plate 140 has four spring leafs 141 extending from two side surfaces 143 of the grounding plate 140 toward each other. The spring leaf 141 are configured to respectively be engaged with the base 130. When the grounding plate 140 is mounted on the base 130, two spring leafs 141 respectively correspond to the through holes 131 of the base 130. A front end of the spring leaf 141 inserts in to the through hole 131 of the base 130, and pushes a top of the through hole 131 to be fixed with the base.

Figure 9:
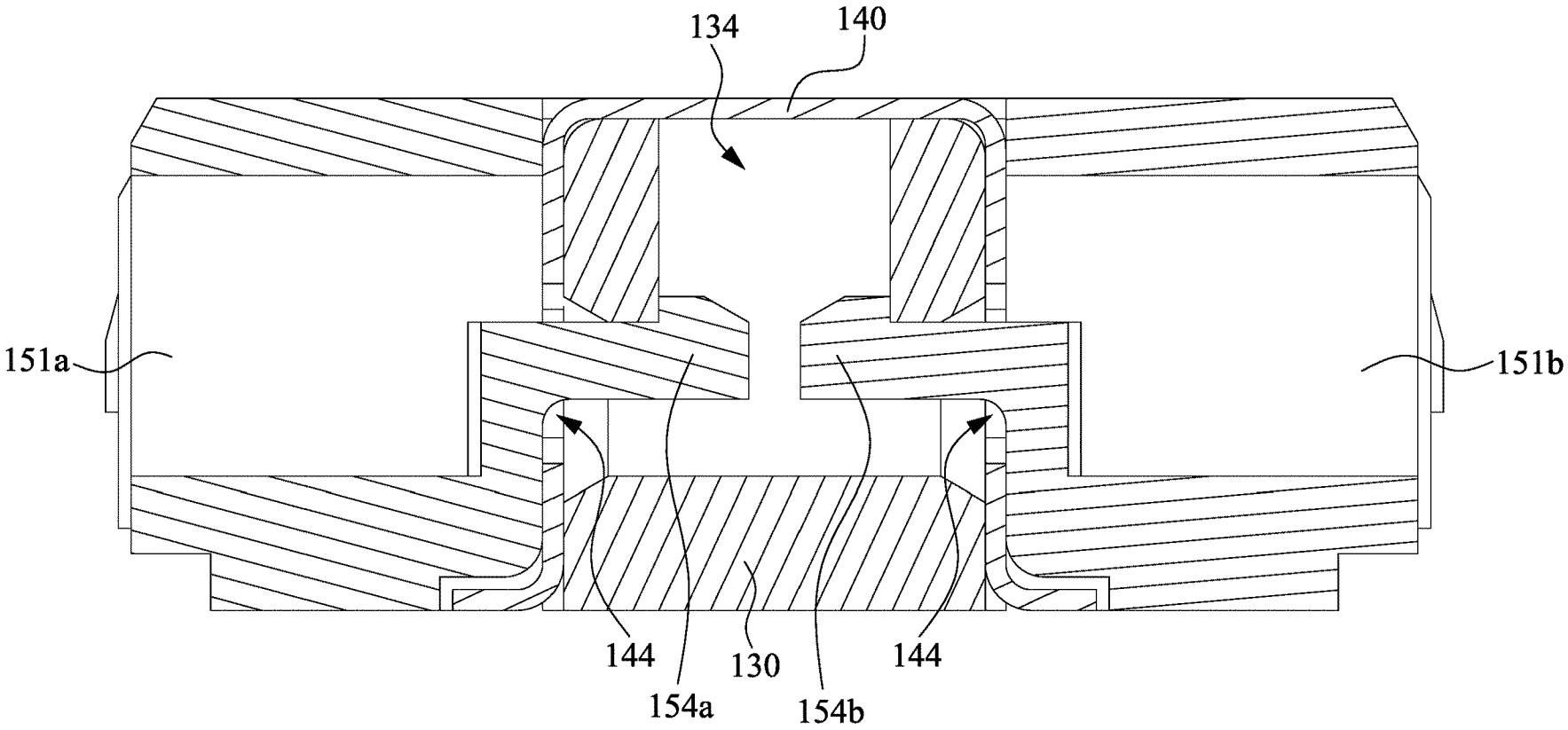
FIG. 9 is a cross-sectional view taken along line 9-9 when the base, the grounding plate, and the first insulative carrier in FIG. 7 are assembled.

FIG. 9 is a cross-sectional view taken along line 9-9 when the base 130, the grounding plate 140, and the first insulative carrier 151*a* in FIG. 7 are assembled. Reference is made to FIG. 7 and FIG. 9. In the present embodiment, the base 130 further includes an engaging channel 134 communicating a top surface 132 of the base 130 and the two side surfaces 133. The grounding plate 140 has an engaging through hole, and the first insulative carrier 151*a* and the second insulative carrier 151*b* are across the engaging through hole of the grounding plate 140 and are fixed with the base 130. Specifically, the grounding plate 140 further has an engaging hole 144 corresponding to the engaging channel 134. The second insulative carrier 151*b* has a hook 154*b*. Similarly, the first insulative carrier 151*a* also has a hook 154*a*. The hook 154*a*, 154*b* across the engaging holes 144 of the grounding plate 140 and are engaged with a bending portion of the engaging channel 134 of the base 130.

The base 130 further includes a cylindrical through hole 135 communicating two side surfaces 133 of the base 130. The grounding plate 140 has a circular hole 145 corresponding to the cylindrical through hole 135. The second insulative carrier 151*b* has a cylinder 155*b*. Similarly, the first insulative carrier 151*a* has a cylinder 155*a*. The cylinders 155*a*, 155*b* across the circular holes 145 of the grounding plate 140 and are slidably engaged with the cylindrical through holes 135 of the base 130.

Figure 10:
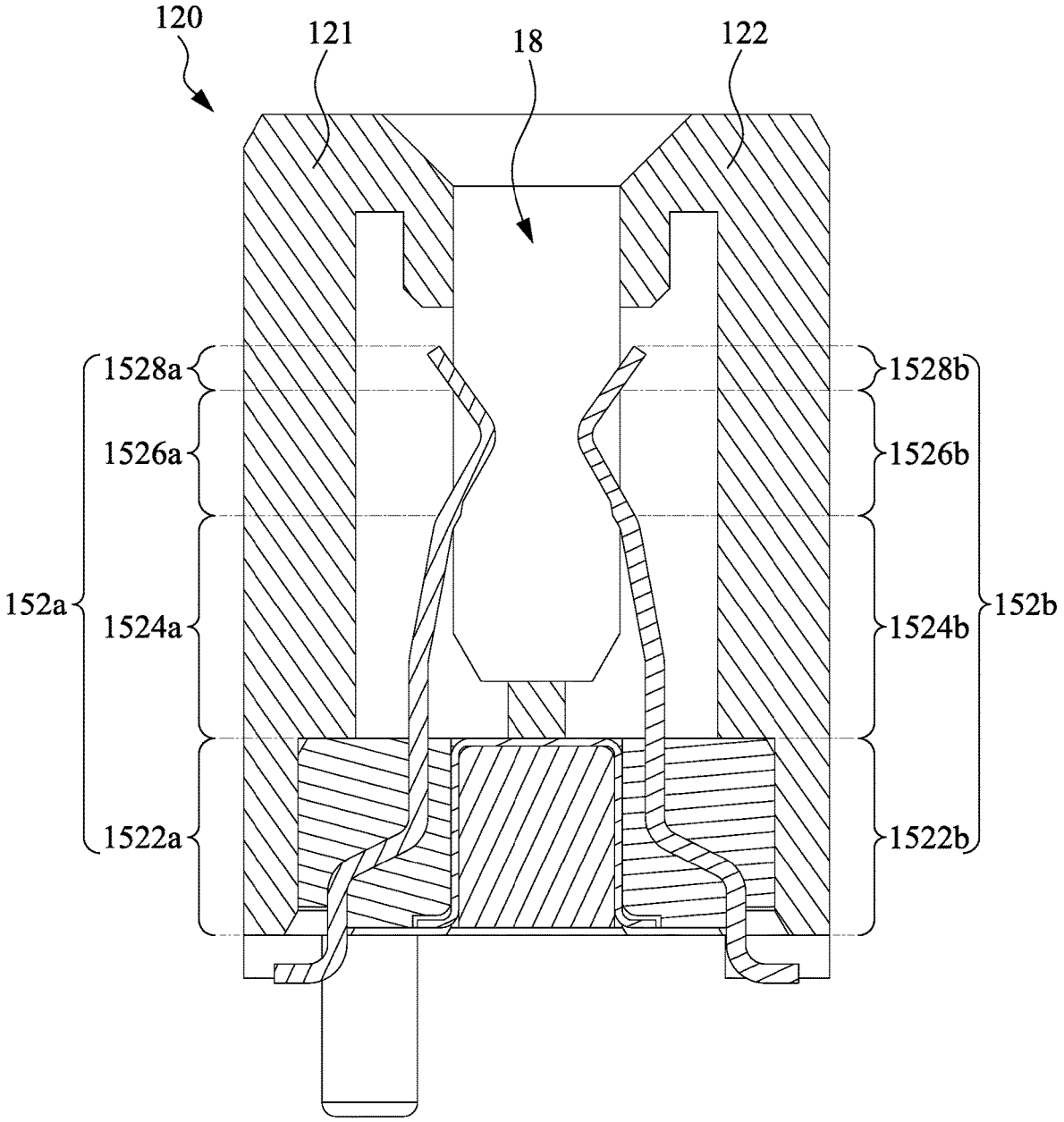
FIG. 10 is a cross-sectional view taken along line 10-10 in FIG. 2.
Figure 11:
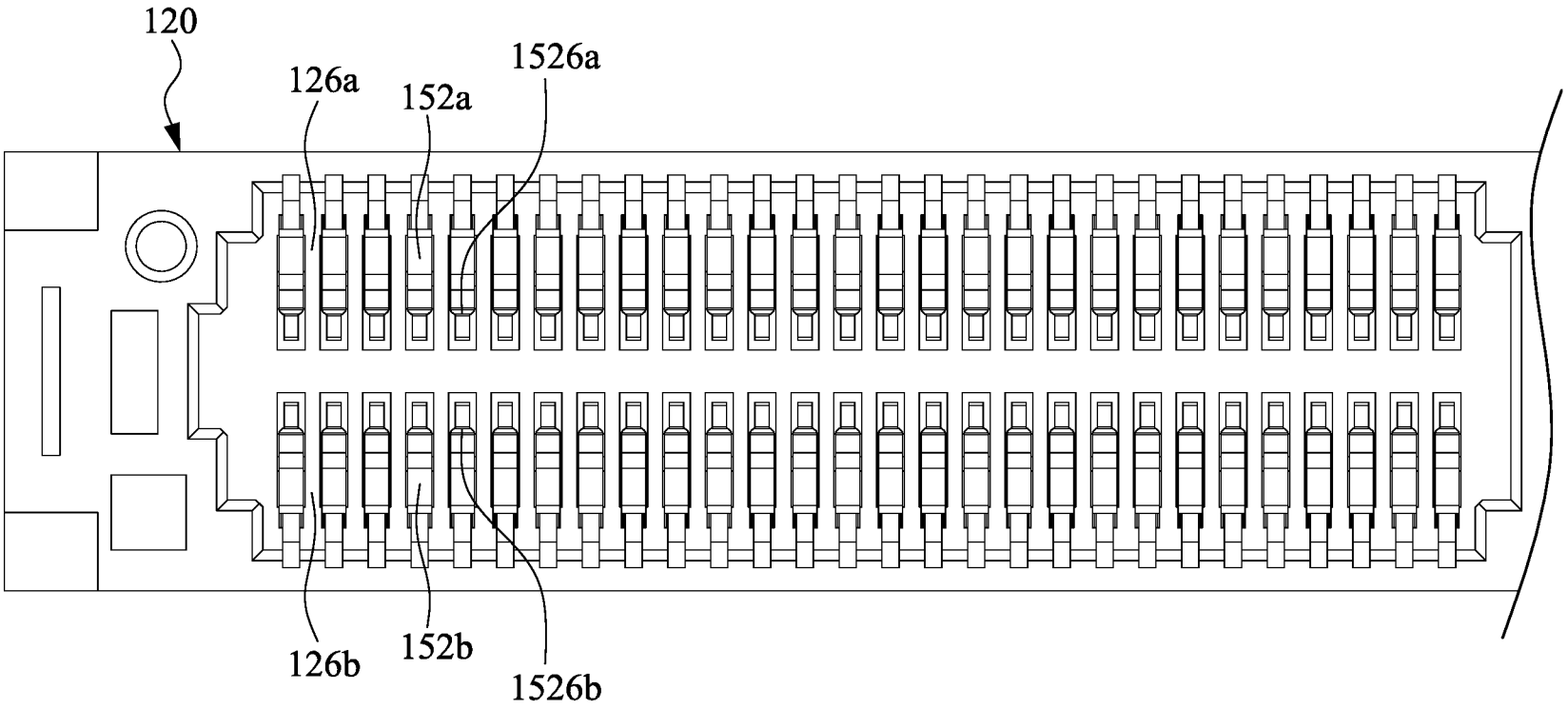
FIG. 11 is a bottom view of the housing, the first contacts, and the second contacts in FIG. 10.

FIG. 10 is a cross-sectional view taken along line 10-10 in FIG. 2. FIG. 11 is a bottom view of the housing 120, the first contacts 152*a*, and the second contacts 152*b* in FIG. 10. Each of the first contacts 152*a* has a connecting section 1524*a*, a contacting section 1526*a* and a contacting end 1528*a* connected sequentially. The connecting sections 1524*a* of the first contacts 152*a* are connected with the corresponding wrapping sections 1522*a* of the first contacts 152*a*. Each of the second contacts 152*b* has a connecting section 1524*b*, a contacting section 1526*b* and a contacting end 1528*b* connected sequentially. The connecting sections 1524*b* of the second contacts 152*b* are connected with the corresponding wrapping sections 1522*b* of the second contacts 152*b*. In some embodiments, the connecting sections 1524*a* and the contacting ends 1528*a* of the first contacts 152*a* are alternately ordered with the first dividing plate 126*a* along the first direction X, and the connecting sections 1524*b* and the contacting ends 1528*b* of the second contacts 152*b* are alternately ordered with the second dividing plate 126*b* along the first direction X. As a result, the contacts are separated from each other to ensure quality of signal transmission.

The contacting sections 1526*a*, 1526*b* of the first contacts 152*a* and the second contacts 152*b* are located in the receiving space 18 so as to be electrically connected with the plug connector 16 (see FIG. 1). As shown in FIG. 11, in the present embodiment, vertical projections of the contacting sections 1526*a*, 1526*b* of the first contacts 152*a* and the second contacts 152*b* are free from overlapping with a vertical projection of the supporting strip 125.

Reference is made to FIG. 7 again. The grounding plate 140 further includes a plurality of grounding contacts 146 that are in contact with the wrapping sections 1522*a*, 1522*b* of the first contacts 152*a* and the second contacts 152*b*, for example, there may be a plurality of first grounding contacts and a plurality of second grounding contacts. As mentioned above, the housing 120 is heated during the fabrication process and external force is applied on the contact assembly 150 through the grounding plate 140. Therefore, the typical housing is easier to be forced apart and be deformed.

In the present embodiment, the first dividing plates 126*a* and the second dividing plates 126*b* respectively extending from the first side wall 121 and the second side wall 122 are configured to be alternately ordered with the first contacts 152*a* and the second contacts 152*b*. And the first dividing plates 126*a* and the second dividing plates 126*b* are fixed to the first end wall 123 and the second end wall 124 through the supporting strips 125. As a result, the housing 120 may include a cross-shaped supporting structure so as to uniformly against the force and maintain the electrical connection between the first contacts 152*a*, the second contacts 152*b*, and the grounding contacts 146. Furthermore, design of the supporting strips 125, the first dividing plates 126*a*, and the second dividing plates 126*b* makes the injection process and the filing process be easier. Therefore, the molding design of the dividing plate is improved and the supporting strip may increase the bonding force of the dividing plates to further increase the yield rate.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A receptacle connector applied for connecting with a plug connector, wherein the receptacle connector comprises:

a contact assembly, comprising:

a plurality of first contacts and a plurality of second contacts arranged along a first direction, wherein each of the first contacts and the second contacts has a wrapping section, the first contacts are reversely arranged side by side with the second contacts along a second direction perpendicular to the first direction; and a first insulative carrier and a second insulative carrier respectively wraps the wrapping sections of the first contacts and the second contacts;

a base, wherein the first insulative carrier has a first hook, the second insulative carrier has a second hook opposite to the first hook, and the first hook and the second hook are configured to be engaged with the base; and a housing including a receiving space configured to receive the plug connector, and the housing wraps a part of the contact assembly, wherein the housing comprises:

a first side wall and a second side wall extending along the first direction;

a first end wall and a second end wall extending along the second direction, wherein the first side wall and the second side wall are respectively connected with the first end wall and the second end wall and form the receiving space;

a supporting strip extending along the first direction, wherein two ends of the supporting strip are respectively connected with the first end wall and the second end wall; and a plurality of first dividing plates and a plurality of second dividing plates, wherein the first dividing plates extend from the first side wall toward the receiving space and are connected with the supporting strip, and the second dividing plates extend from the second side wall toward the receiving space and are connected with the supporting strip.

2. The receptacle connector of claim 1, wherein each of the first dividing plates has a first protruding portion wrapped by the first side wall, and each of the second dividing plates has a second protruding portion wrapped by the second side wall.

3. The receptacle connector of claim 1, wherein a width of a bottom of each of the first dividing plates along the second direction is greater than a width of a top of each of the first dividing plates along the second direction.

4. The receptacle connector of claim 1, wherein adjacent two of the first dividing plates form a first contact channel, and adjacent two of the second dividing plates form a second contact channel.

5. The receptacle connector of claim 4, wherein a side of the first contact channel away from the receiving space is closed by the first side wall, and a side of the second contact channel away from the receiving space is closed by the second side wall.

6. The receptacle connector of claim 4, wherein the first contact channel and the second contact channel communicate with the receiving space.

7. The receptacle connector of claim 1, wherein each of the first contacts and each of the second contacts has a connecting section, a contacting section and a contacting end connected sequentially, the connecting section is connected with the wrapping section, the connecting sections and the contacting ends of the first contacts are alternately ordered with the first dividing plates along the first direction, and the connecting sections and the contacting ends of the second contacts are alternately ordered with the second dividing plates along the first direction.

8. The receptacle connector claim 7, wherein the contacting sections of the first contacts and the second contacts are located in the receiving space.

9. The receptacle connector of claim 8, wherein vertical projections of the contacting sections of the first contacts and the second contacts are free from overlapping with a vertical projection of the supporting strip.

10. The receptacle connector of claim 1, further comprising a grounding plate mounted and fixed on the base, wherein the first insulative carrier and the second insulative carrier are engaged with two opposite sides of the grounding plate.

11. The receptacle connector of claim 10, wherein the first insulative carrier and the second insulative carrier are across an engaging through hole of the grounding plate and are fixed to the base.

12. A receptacle connector applied for connecting with a plug connector, wherein the receptacle connector comprises:

a contact assembly, comprising:

a plurality of first contacts and a plurality of second contacts arranged along a first direction, wherein each of the first contacts and the second contacts has a wrapping section, the first contacts are reversely arranged side by side with the second contacts along a second direction perpendicular to the first direction; and a first insulative carrier and a second insulative carrier respectively wraps the wrapping sections of the first contacts and the second contacts;

a housing including a receiving space configured to receive the plug connector, and the housing wraps a part of the contact assembly, wherein the housing comprises:

a first side wall and a second side wall extending along the first direction;

a first end wall and a second end wall extending along the second direction, wherein the first side wall and the second side wall are respectively connected with the first end wall and the second end wall and form the receiving space;

a supporting strip extending along the first direction, wherein two ends of the supporting strip are respectively connected with the first end wall and the second end wall; and a plurality of first dividing plates and a plurality of second dividing plates, wherein the first dividing plates extend from the first side wall toward the receiving space and are connected with the supporting strip, and the second dividing plates extend from the second side wall toward the receiving space and are connected with the supporting strip;

a base fixed to a bottom of the housing and located below the supporting strip, wherein the base is configured to fix the contact assembly; and a grounding plate mounted and fixed on the base, wherein the first insulative carrier and the second insulative carrier are engaged with two opposite sides of the grounding plate.

13. The receptacle connector of claim 12, wherein the first insulative carrier and the second insulative carrier are across an engaging through hole of the grounding plate and are fixed to the base.

14. The receptacle connector of claim 12, wherein the grounding plate has a plurality of spring leafs extending from two side surfaces of the grounding plate toward each other, and the spring leafs are configured to respectively be engaged with the base.

15. The receptacle connector of claim 12, wherein the grounding plate has a plurality of grounding contacts that are in contact with the wrapping sections of the first contacts and the second contacts.

16. The receptacle connector of claim 12, wherein each of the first insulative carrier and the second insulative carrier has a cylinder, the grounding plate has a circular hole, the base has a cylindrical through hole, and each of the cylinder is across the circular hole of the grounding plate and is slidably engaged with the cylindrical through hole of the base.

17. The receptacle connector of claim 12, wherein adjacent two of the first dividing plates form a first contact channel, and adjacent two of the second dividing plates form a second contact channel.

18. The receptacle connector of claim 17, wherein a side of the first contact channel away from the receiving space is closed by the first side wall, and a side of the second contact channel away from the receiving space is closed by the second side wall.

* * * * *